US005187916A

United States Patent [19]

Errani et al.

[11] Patent Number: 5,187,916

[45] Date of Patent: Feb. 23, 1993

[54] GRIPPER FOR PLASTIC FILM AUTOMATIC MACHINE

[75] Inventors: Franca Errani; Marino Missirini, both of Bologna, Italy

[73] Assignee: Derifan S.p.A., Montecorvino Pugliano, Italy

[21] Appl. No.: 714,149

[22] Filed: Jun. 7, 1991

[30] Foreign Application Priority Data

Jun. 8, 1990 [IT] Italy ..... 4842/90[U]

[51] Int. Cl.[5] ..... B65B 41/04

[52] U.S. Cl. ..... 53/389.2; 53/556; 296/116

[58] Field of Search ..... 53/556, 587, 389.2; 294/116, 102.1

[56] References Cited

U.S. PATENT DOCUMENTS

| | | | |
|---|---|---|---|
| 729,939 | 6/1903 | Jones | 294/116 |
| 2,384,636 | 9/1945 | Nelson | 294/102.1 |
| 2,478,034 | 8/1949 | Zademach | 294/116 X |
| 2,729,042 | 1/1956 | Brook | 53/389.2 |
| 3,279,017 | 10/1966 | Tellefson | 294/102.1 |
| 3,630,391 | 12/1971 | Wilson | 294/116 |

FOREIGN PATENT DOCUMENTS

| | | | |
|---|---|---|---|
| 2717647 | 11/1978 | Fed. Rep. of Germany | 53/556 |
| 241856 | 8/1946 | Switzerland | 294/116 |
| 1557054 | 4/1990 | U.S.S.R. | 294/102.1 |

*Primary Examiner*—John Sipos
*Attorney, Agent, or Firm*—Herbert Dubno

[57] ABSTRACT

Gripper for plastic film grasping, particularly suitable for automatic wrapping machines equipped with turntables is, provided with plates sliding into mobile guides, whose convergence is allowed during closing phase by a device fitting between the guides.

5 Claims, 2 Drawing Sheets

GRIPPER FOR PLASTIC FILM AUTOMATIC MACHINE

FIELD OF THE INVENTION

The present invention relates to a gripper for the grasping of plastic film for automatic wrapping machines, having a turntable, receiving the load to be wrapped.

BACKGROUND OF THE INVENTION

It is known that, for an automatic plastic film wrapping machine, particularly suitable for suitcases, a gripper for plastic film grasping was designed to have two plates sliding into guides fastened to a support. Gripper opening and closing are operated by the plate sliding into guides whose longitudinal axes converge into the closing point of the gripper. The plate is operated through levers connected to the guide plates by means of pin pairs perpendicularly fastened to them. This kind of gripper has the disadvantage of a very narrow field of operation where the film grasping is allowed through the convergence of the mobile elements in the fixed guides. This means that, if the gripper/film relative position is out of a designed position, the grasping can fail and put the machine out of order, thus compromising its automatic functioning conception.

OBJECTS OF THE INVENTION

It is therefore the principal object of the present invention to provide a gripper avoiding disadvantages known in the prior art.

SUMMARY OF THE INVENTION

The gripper for plastic film grasping according to the invention comprises two plates sliding into mobile guides, whose convergence is allowed, during a closing phase, by a device fitting between the guides.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

The gripper is formed with a support 1 on which guides 2*a* and 2*b* are fastened in an oscillatory ways. Between the guides plates 3*a* and 3*b*, provided with the pairs of pins 4*a*/4*b* and 5*a*/5*b*, respectively, are slidably mounted.

Between the pin pairs a bar 6 is positioned and connected through arm 7 to bar 8, whose rotation, within a predetermined circle arc causes gripper opening and closing. Bar 6 is continuously engaged between respective pairs of pins.

Figure 4:
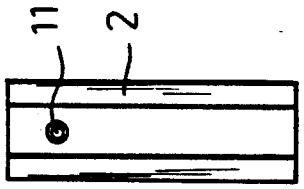
FIG. 4 is a front view of one of the plateholder guides.
Figure 5:
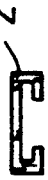
FIG. 5 is a top view of on of upsaid guides.
Figure 3:
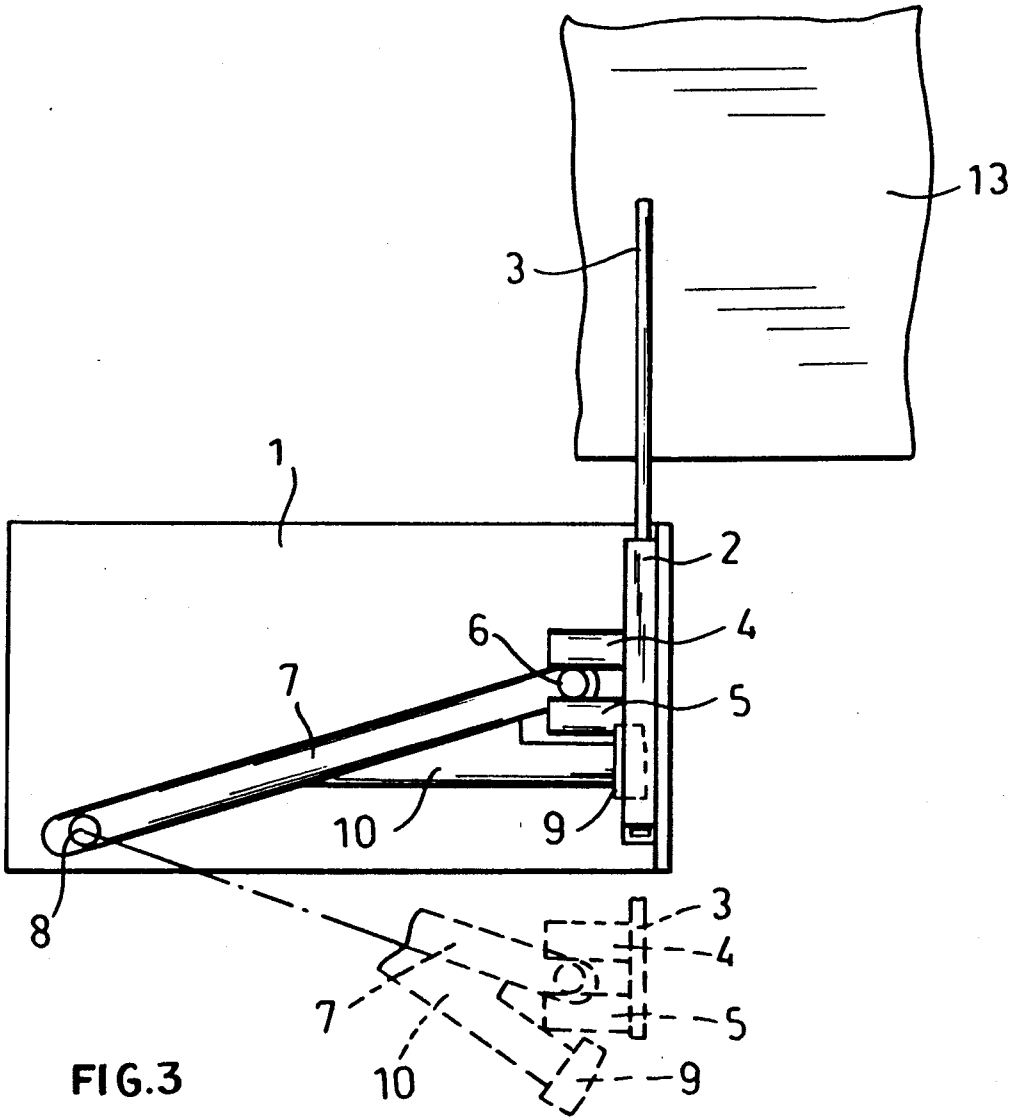
FIG. 3 is a right lateral view of the gripper in its closing position, with a dashed partial detail of the open gripper.

Arm 7 is provided with element 10 at whose end device 9 is fastened. The device is appropriately shaped (e.g. wedge-shaped) to fit, during closing, between guides 2*a* and 2*b*. These guides, whose schematic shape is represented in FIGS. 4 and 5, are provided with a hole 11 to allow the passage of an appropriate screw for fastening the guides to support 1 in an oscillatory way.

Support 1 is provided with element 1*a* having a through whole and acting as a guide for bar 8, and dowel 12 as locating element for the oscillating guides 2*a* and 2*b* during gripper closing.

The operation of the gripper is very simple and is described hereunder.

Figure 1:
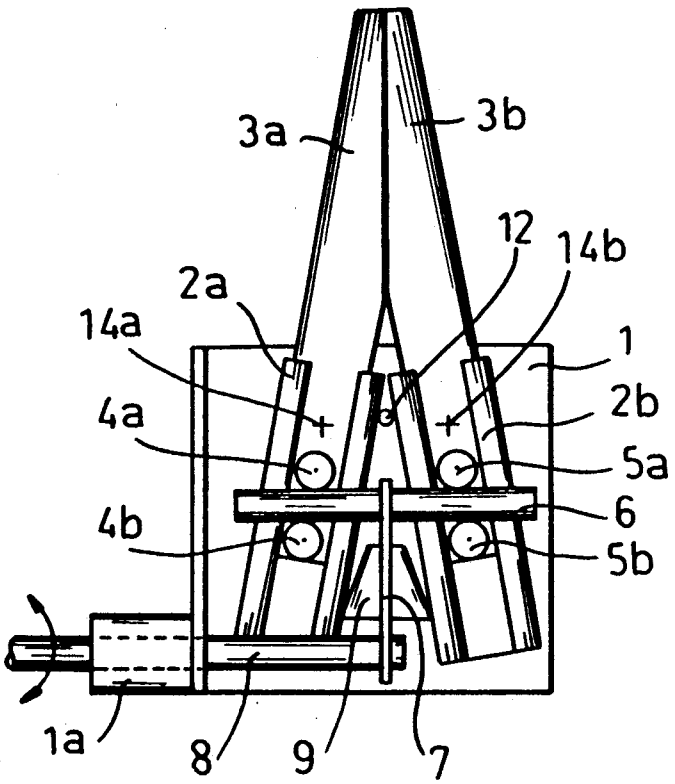
FIG. 1 is a front view of the gripper in its closing position.

When the gripper is closed (FIG. 1), the downward displacement of bar 6, thanks to bar 8 rotation, causes plates 3*a*/3*b*, sliding into guides 2*a*/2*b*, to go down.

As these guides oscillate in their upper part, they become parallel as soon as device 9 releases from them.

Figure 2:
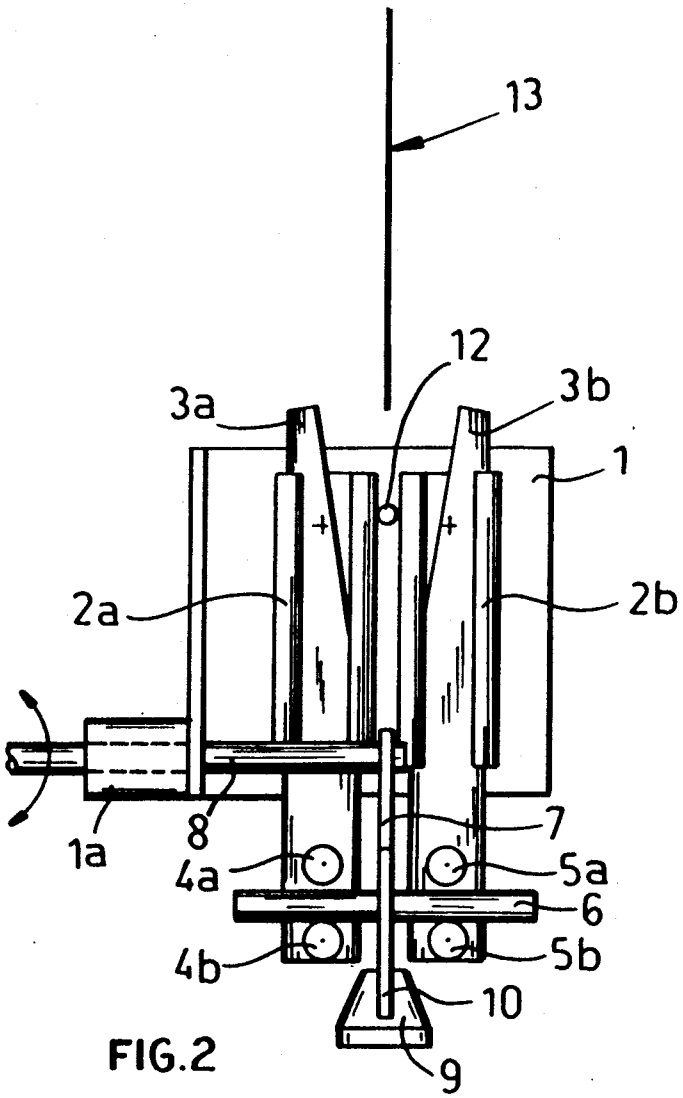
FIG. 2 is a front view of the gripper in its opening position.

When the gripper is open (FIG. 2), the plates will be parallel and positioned downwards at the end-of-stroke of the wedge, with their ends wide apart.

During closing, for plastic film 13 grasping bar 6 comes up and causes plates 3*a*/3*b* to rise. The plates will be parallel for a long stretch, until device 9 fits between guides 2*a*/2*b*, thus helping their convergency as a consequence of the specular rotation of the guide plates around their respective oscillation axes 14*a*/14*b*.

When bar 8 completes its rotation within its working art, device 9 will be completely fitted between guides 2*a*/2*b*. Plates 3*a*/3*b* will be in upper positions at the end-of-stroke and joined in this way so that plastic films 13 grasping will be carried out by the gripper.

The gripper allows film grasping even if the film is not strictly into the narrow field passing through the vertical axis of the gripper itself. As a matter of fact, plates, before closing, will cover a long stretch, thus allowing the gripper to grasp the film even if it is misaligned.

This special characteristic is particularly suitable for automatic machines operated by unskilled operators.

The present invention, schematically described above in an explicative way, according to the shown but not restrictive embodiment, can be extended to all alternatives falling within the scope of the invention.

Practically, sizes and materials can be varied according to needs and the technical details can be replaced by other equivalent ones, without departing from the scope of the invention.

We claim:

1. A gripper for an automatic plastic film wrapping machine, said machine comprising:

a support;

a horizontal shaft mounted on said support and oscillating about the longitudinal shaft axis;

a support rod spaced radially from and rotatably fixed with said shaft to vertically move as result of said shaft oscillation, said rod having a rod axis extending parallel to said shaft axis;

a pair of spaced apart guide plates mounted swingably about respective parallel oscillatory axes extending horizontally perpendicular to said shaft axis on said support and formed with respective tops and bottoms;

a pair of gripping jaws mounted slidably on said guides and formed with respective upper and lower ends, said upper ends projecting over tops of said guides and gripping a film therebetween in a gripping position of the jaws and releasing the film in an open position of said jaws and said lower ends slidably engaging said rod so that said gripper jaws vertically move with said rod; and an upwardly narrowing wedge fixed rotationally with said shaft to swing along an arcuate path and engageable between said guide plates to converge said tops in a position thereof corresponding to said gripping position of the jaws, said plates being parallel to one another in another position thereof corresponding to said open position of said jaws upon removal of said wedge from between the guide plates along said path.

2. The gripper defined in claim 1 wherein said wedge is spaced downwardly from said lower ends of the jaws projecting below said bottoms of said plates in said open position of said jaws.

3. The gripper defined in claim 1, further comprising:

a bar mounted on and extending radially from said shaft, said bar being formed with a free end rigidly connected with said support rod;

an arm rigidly attached to said bar and extending angularly downwardly from said bar toward said bottoms of said guides, said arm being formed with a respective free end carrying said wedge; and engaging means formed on bearing faces of said jaws for providing an engagement between said support rod and said jaws along said arcuate path.

4. The gripper defined in claim 2 wherein said engaging means includes two pairs of respective upper and lower pins extending laterally from said bearing faces of said jaws, said rod being continuously engaged between pins of the respective pairs.

5. The gripper defined in claim 1 wherein said upper ends of said jaws are wedge-shaped, said guide plates being provided with at least one dowel.

* * * * *